US006505784B1

(12) United States Patent
Jou

(10) Patent No.: US 6,505,784 B1
(45) Date of Patent: Jan. 14, 2003

(54) AIR BLOWGUN

(76) Inventor: Wuu-Cheau Jou, No. 497-6, Tsao Hu Rd., Da Li City, Taichung Hsien (TW)

( * ) Notice: Subject to any disclaimer, the term of this patent is extended or adjusted under 35 U.S.C. 154(b) by 0 days.

(21) Appl. No.: 09/897,944

(22) Filed: Jul. 5, 2001

(51) Int. Cl.[7] ..... B05B 9/01

(52) U.S. Cl. ..... 239/525; 239/390; 239/396; 239/397; 239/526; 239/DIG. 21; 239/DIG. 22

(58) Field of Search ..... 239/290, 390, 239/391, 396, 525, 526, 590, 590.3, 397, DIG. 21, DIG. 22

(56) References Cited

U.S. PATENT DOCUMENTS 3,980,238 A * 9/1976 Adiletta ..... 239/DIG. 22
5,765,758 A * 6/1998 Chu ..... 239/526
5,832,974 A * 11/1998 Jou ..... 239/600
6,142,387 A * 11/2000 Jou ..... 239/526
6,213,411 B1 * 4/2001 Jou ..... 239/526

* cited by examiner

*Primary Examiner*—Robin O. Evans
(74) *Attorney, Agent, or Firm*—Rosenberg, Klein & Lee

(57) ABSTRACT

The present invention relates to an air blowgun, and more particularly to an innovated blowpipe mechanism of the air blowgun, which can secure with variety nozzles individually for meeting to different purposes. Wherein a thread is set on the tip end of the blowpipe, thereby to connect with an extending long blowpipe, a screen nozzle, a charging adapter, a plug-in charging connector, a low-pressure nozzle, a soft nozzle, or a vent wire and so on to form multifunction tool, and it has small volume, easy mounting and replacing operation and facilitating carryover feathers.

2 Claims, 16 Drawing Sheets

AIR BLOWGUN

BACKGROUND OF THE INVENTION

1. Field of the Invention

The present invention relates to an air blowgun, and more particularly to an innovated blowpipe mechanism of the air blowgun.

2. Description of Prior Art

In accordance with the conventional air blowgun 10 with a 4-inches standard length blowpipe, as shown in FIG. 1, it just only has a single function—blowing dust. Due to 80-psi pressure of discharge press, the conventional air blowgun 10 sprays wind-stream so fast that dust and debris will be rejected as blowing on them directly to occur shooting the operator or other people standing nearby dangerously, therefore this kind of over-concentrated high-speed spraying is just only used in site of necessary heavy blowing, so it is a shortcoming of the conventional blowgun.

Because the conventional air blowgun employs a fixed blowpipe mechanism—the blowpipe is unable to be replaced, if operating in a narrow and deep site or meeting obstructer-can not extend the arm of the operator in the site, a long blowgun 20 has to be needed, as shown in FIG. 2, to the object, but the long blowgun 20 is difficult to work in a narrow short distance places, it hampers the wrist moving, so the user has to prepare long and short blowgun in the meantime for using in different working site. If the working site is a long distance in outside, the worker has to carry the different blowguns with him, it will bring him to inconvenience. This is another shortcoming of the conventional blowgun.

When the conventional air gun with single function is used in other purposes, such as inflating tire to connect to different air gate, and pumping up a ball to connect to vent wire and so on, the individual adapting connectors must be needed, and mounted or removed from the tip of the blowgun as rapid as possible in order to replace another for meeting to other purpose, but the shortcoming of the individual connectors is too big volume, or too long length to occupy too much space to bring up inconvenience of carryover.

OBJECTS AND SUMMARY OF THE INVENTION

It is therefore a main object of the present invention to provide an air blowgun having a connecting thread at the tip of the blowpipe for connecting different nozzles facilitating carryover and operation.

DETAILED DESCRIPTION OF PREFERRED EMBODIMENTS

Figure 1:
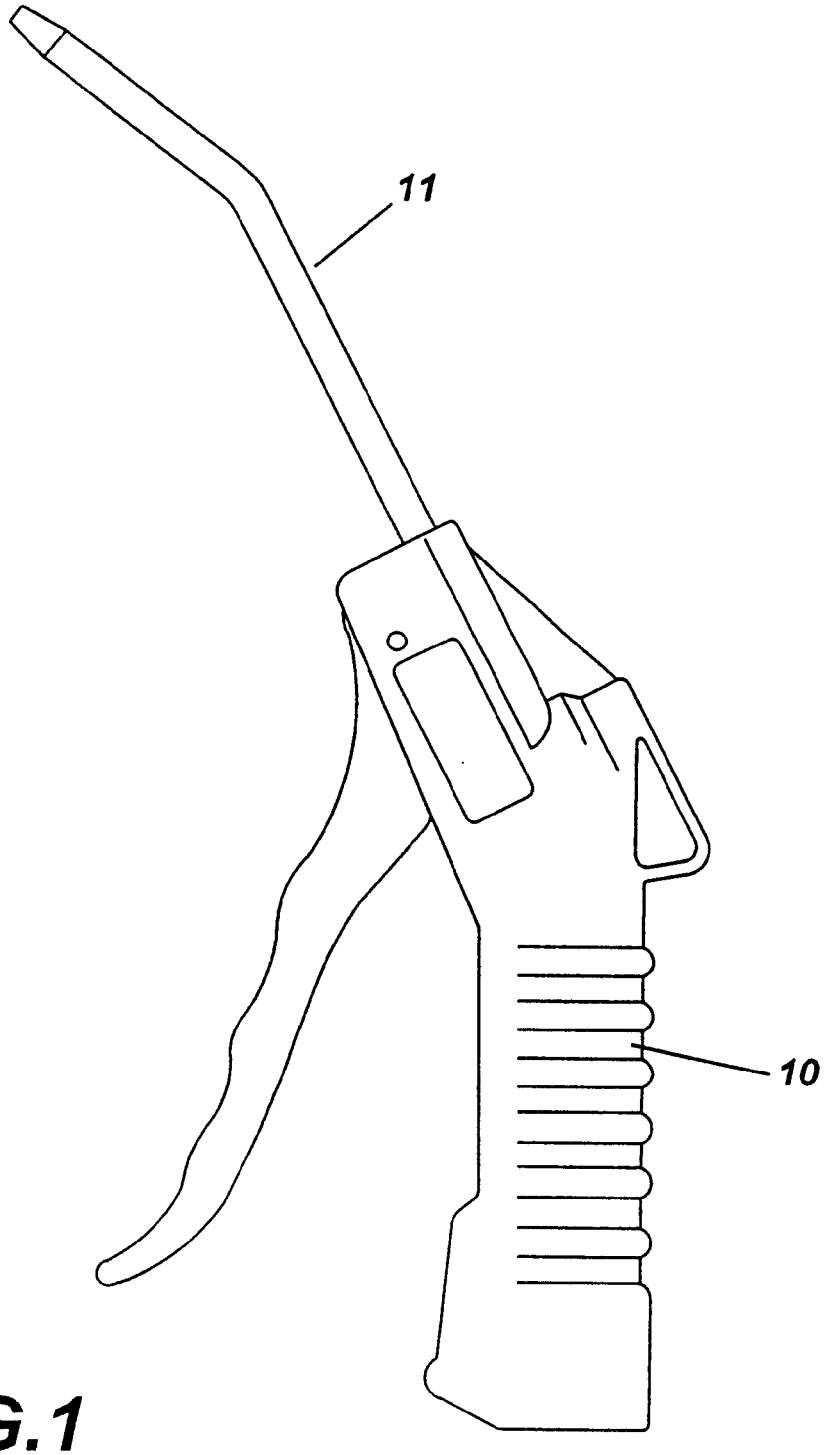
FIG.1 PRIOR ART
FIG. 1 is a side view showing a conventional short blowgun.
Figure 2:
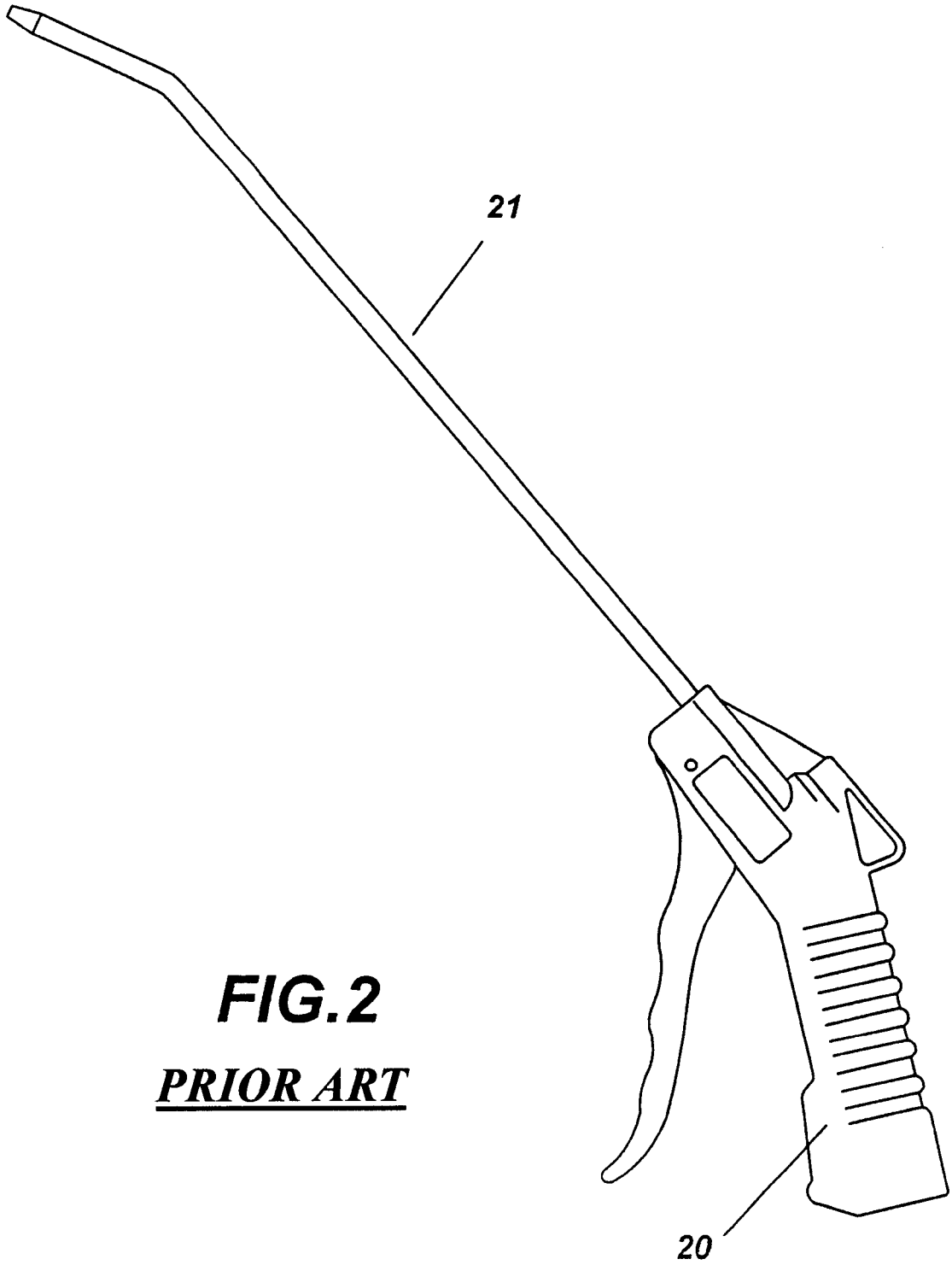
FIG.2 PRIOR ART
FIG. 2 is a side view of a conventional long blowgun.
Figure 3:
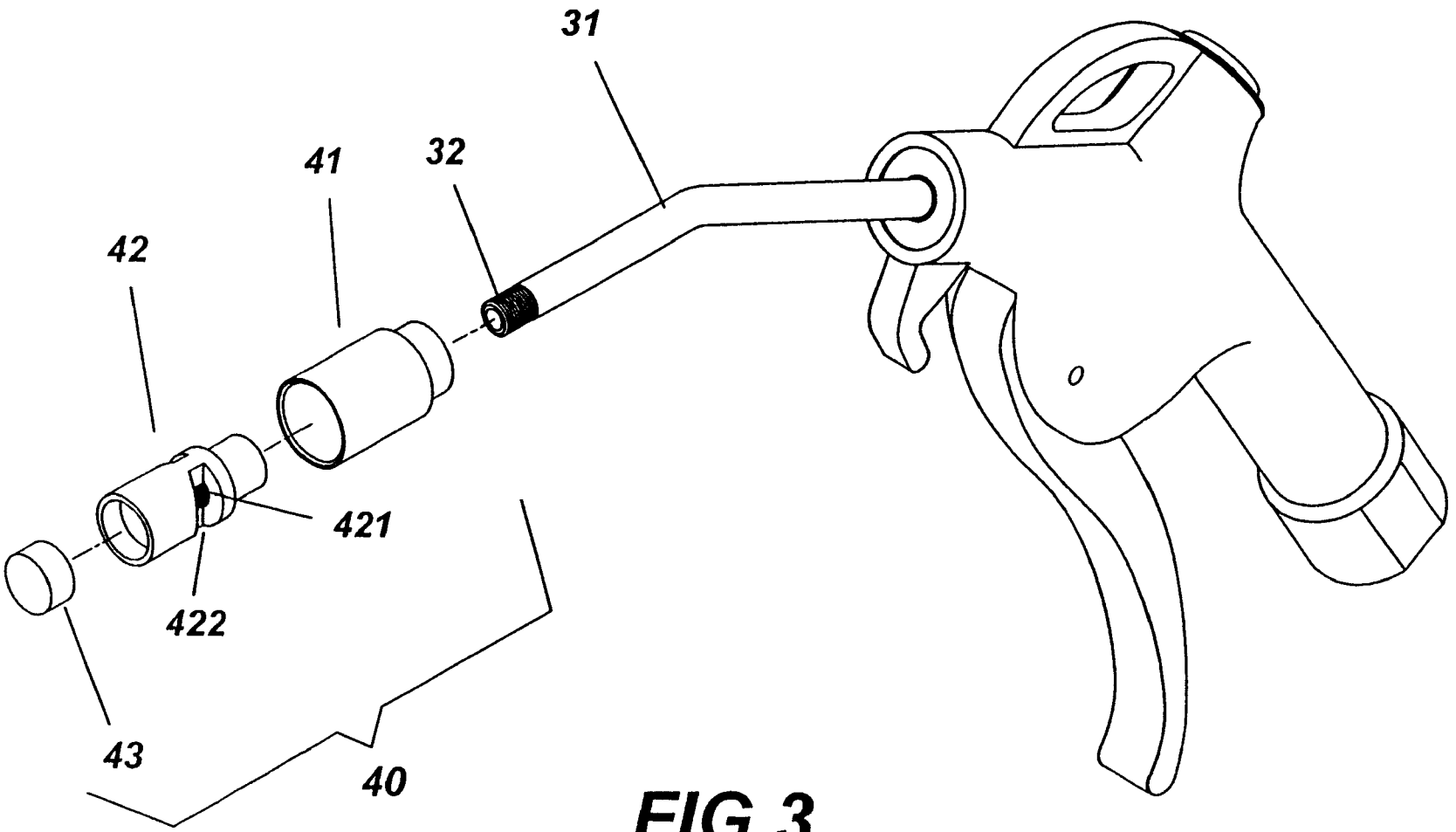
FIG. 3 is an exploded view showing attaching a nozzle having a screen of the present invention.
Figure 4:
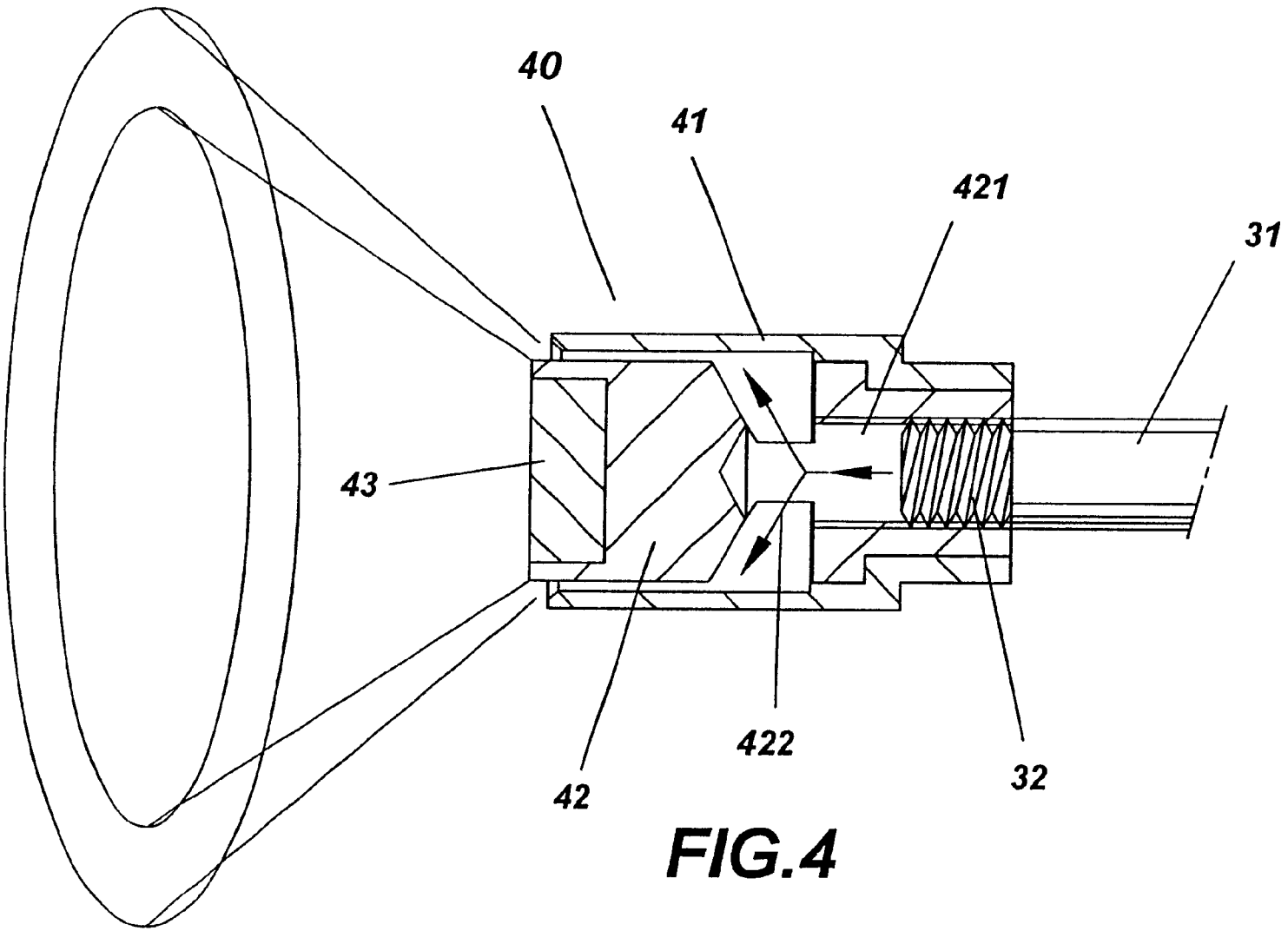
FIG. 4 is a cross-section view showing the screen nozzle combined with the blowgun of the present invention.

Referring to FIG. 3 and FIG. 4, the present invention provides an air blowgun 30 comprising of a connecting thread 32 at the tip of the blowpipe 31 for connecting a screen nozzle 40. Said screen nozzle 40 (as shown in FIG. 3 and FIG. 4) is comprised of a hollow main body 41 and a baffling key 42 contained in the hollow inside of the main body 41. Said baffling key 42 is comprised of a threaded hole 421 at inside end for securing on the blowpipe 31 and leading compressed air in, and a magnet piece 423 embedded into the outside end, and a guide slot 422 crossing the both side and connecting with the threaded hole 421 for leading the compressed air into the inside of the main body 41 to form a ring wind-stream blowing out by the ring gap between the inside wall of the main body 41 and the baffling key 41.

Figure 5:
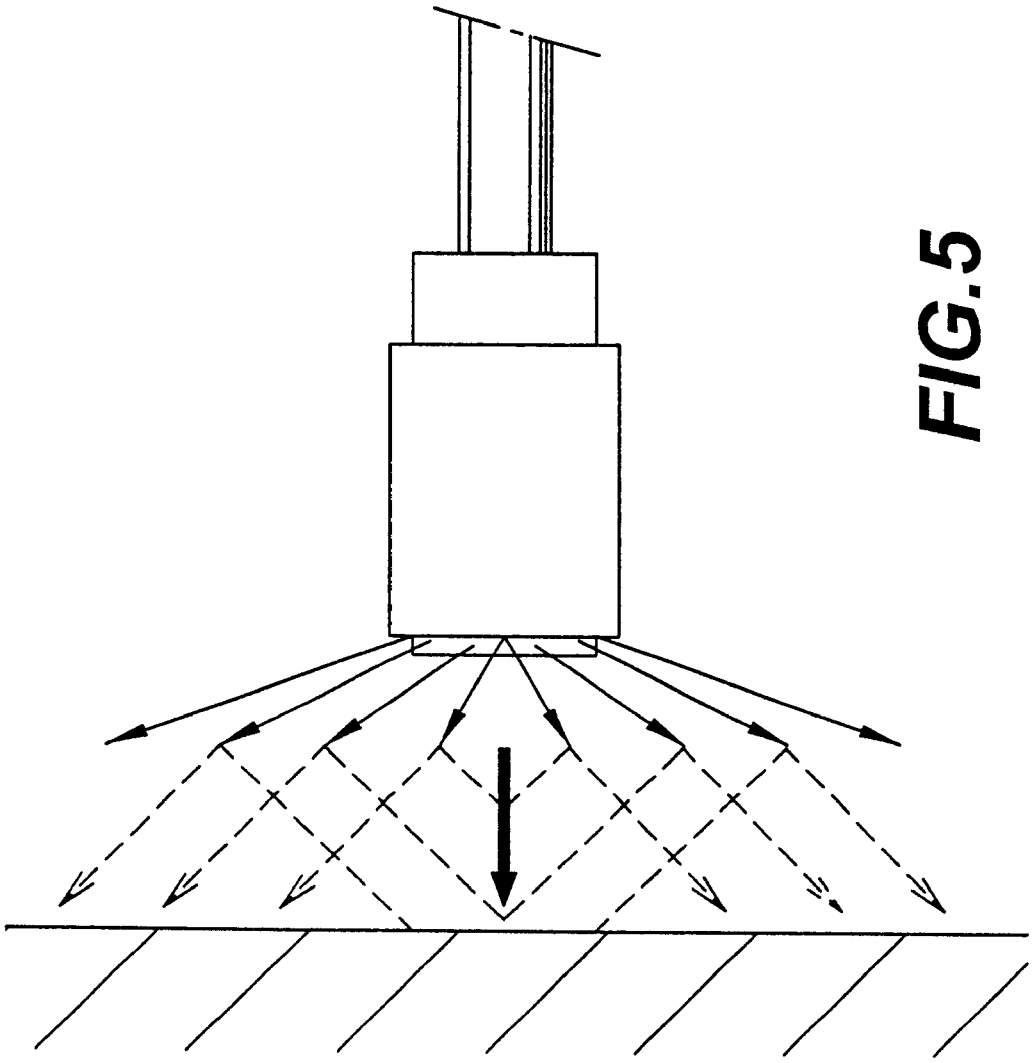
FIG. 5 is a scheme showing guard function of the screen nozzle of the present invention.

Referring to FIG. 4, said screen nozzle 40 may guide the compressed air to spray out in a hollow thin cone, meanwhile by means of the diffused air film to carry out shielding function for prevent dust, water and oil and so on from reflecting to shoot the operator, further to improve the safety of operation, as shown in FIG. 5.

On the other hand, said magnet piece 43 embedded into the tip end of the baffling key 42 makes the screen nozzle 40 have attraction function of attracting steel parts. This kind of screen nozzle 40 can be used in narrow and deep space or the finger unable to touch to places for picking up steel part by the magnet piece 43.

In accordance with above-described, due to employing the connecting thread 32 at the tip of the blowpipe 31, the blowgun can secure with variety nozzle for meeting to different purposes.

Long and Short Blowgun Conversion Function

Figure 6:
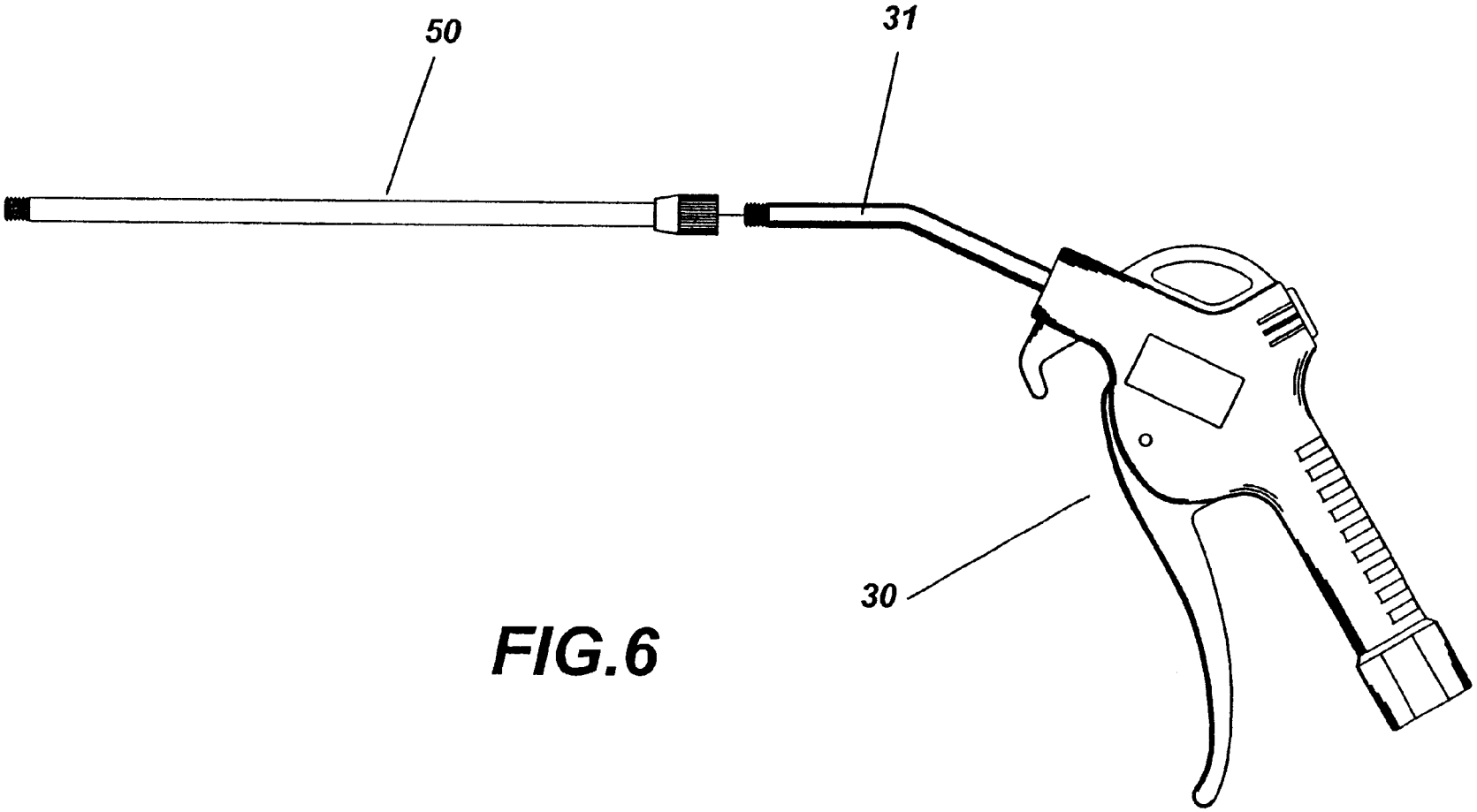
FIG. 6 is a side view showing securing to a long blowpipe of the present invention.

Referring to FIG. 6, securing an extending blowpipe 50 on the tip end of the blowgun 31 of the original short blowgun 30 is carried out said long blowgun conversion function for be used in narrow and deep space or hard touching place blocked by obstacles, and is converted so easily and simply. On the other hand, an extending blowpipe 50 is in convenience of carryover without the bother of carrying two conventional blowguns.

Magnet Attraction Function

Figure 7:
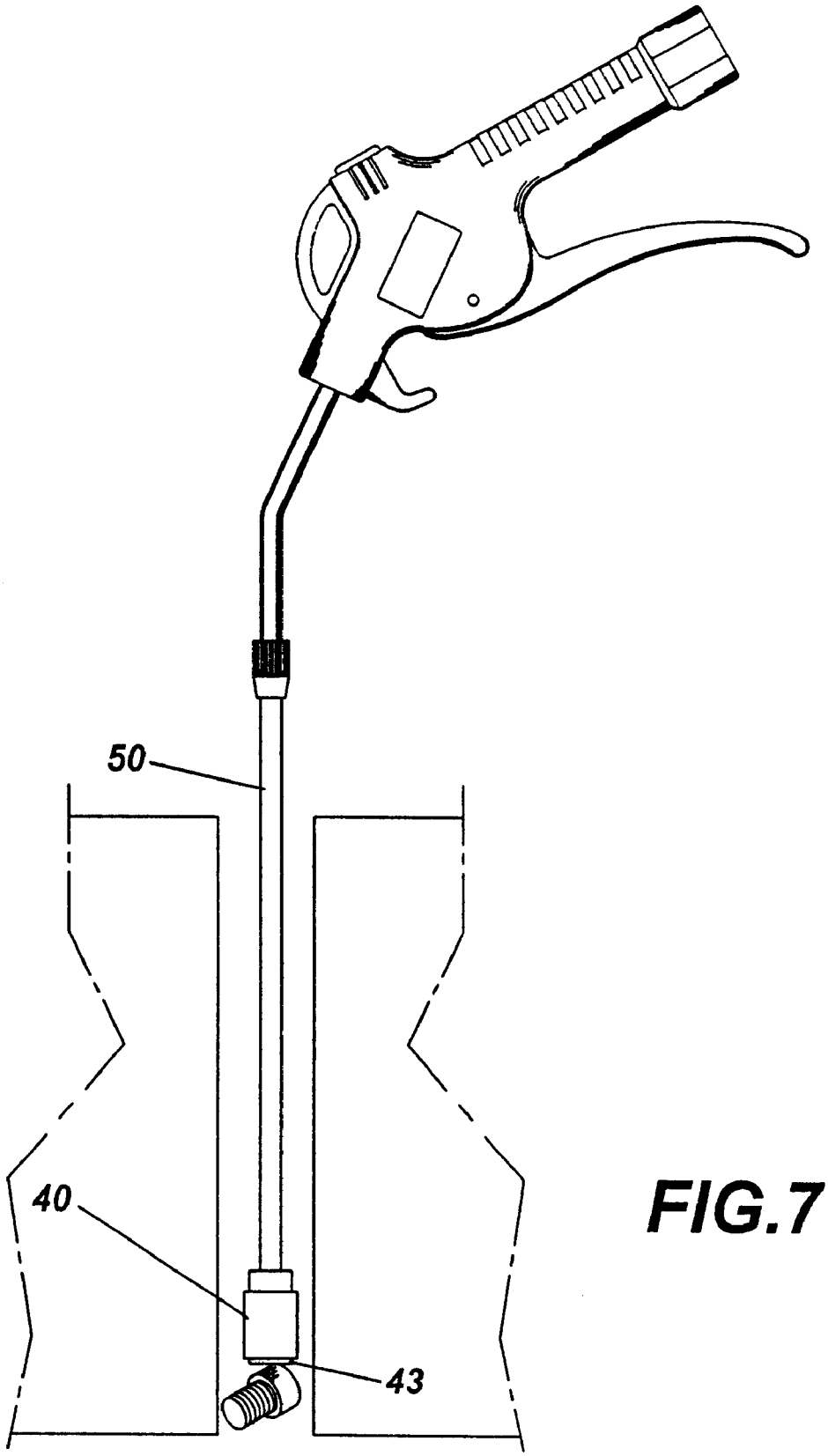
FIG. 7 is a side view showing the long blowgun working in a narrow and deep side to pick up a part with attraction of inside magnet of the present invention.

Said magnet piece 43 embedded into the tip end of the screen nozzle 40 can pick up steel parts falling into a narrow and deep space hard touching place by arm. In general cases, the screen nozzle 40 secured on the short blowgun can deal with shallow space site, but with regarding to narrow and deep places, as shown in FIG. 7, the screen nozzle 40 is secured on the tip end of the long extending blowpipe 50 to pick up the steel parts easily and simply.

Inflating Tire Function

Figure 8:
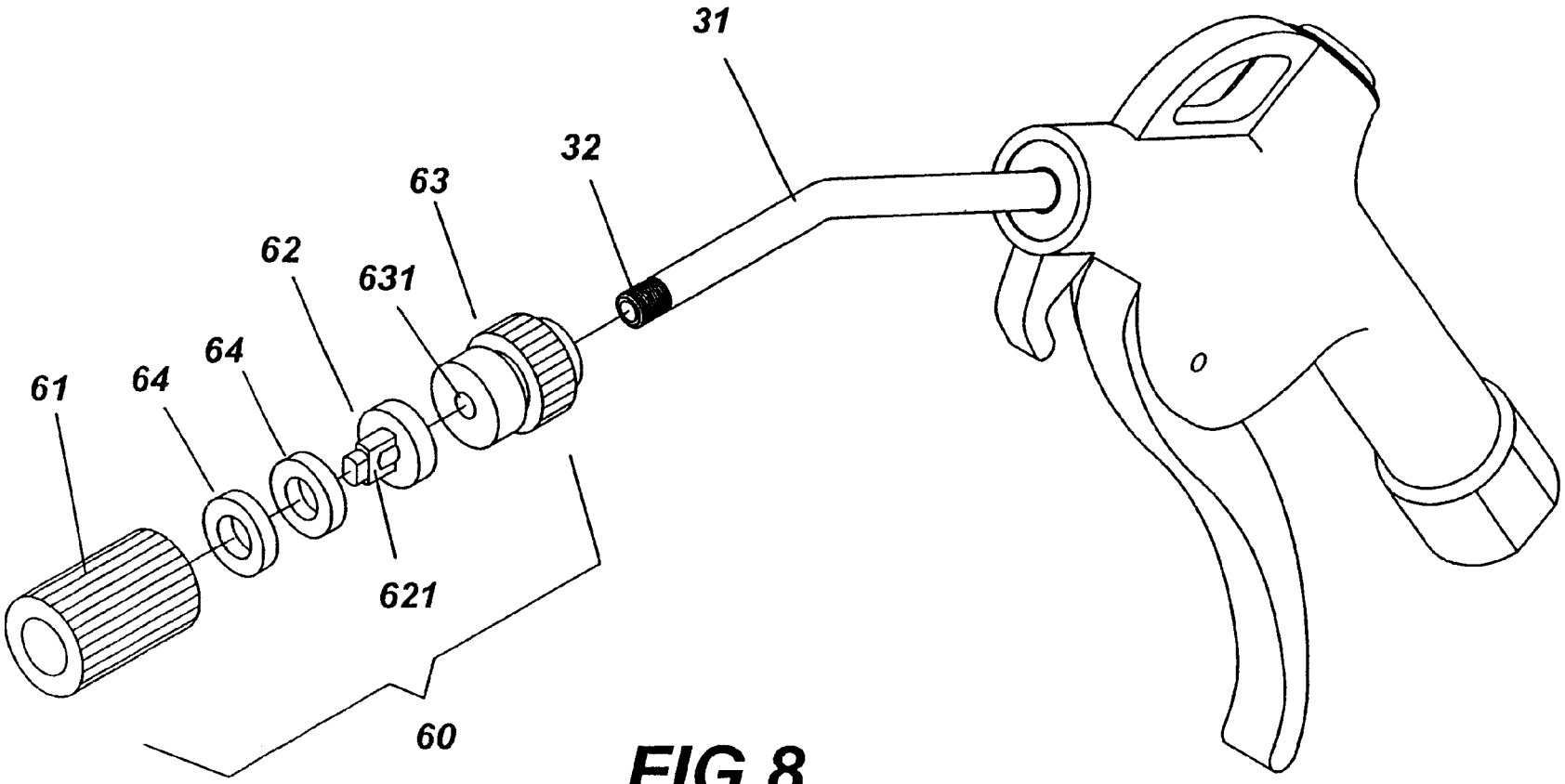
FIG. 8 is an exploded view showing connecting to a charging adapter of the present invention.
Figure 9:
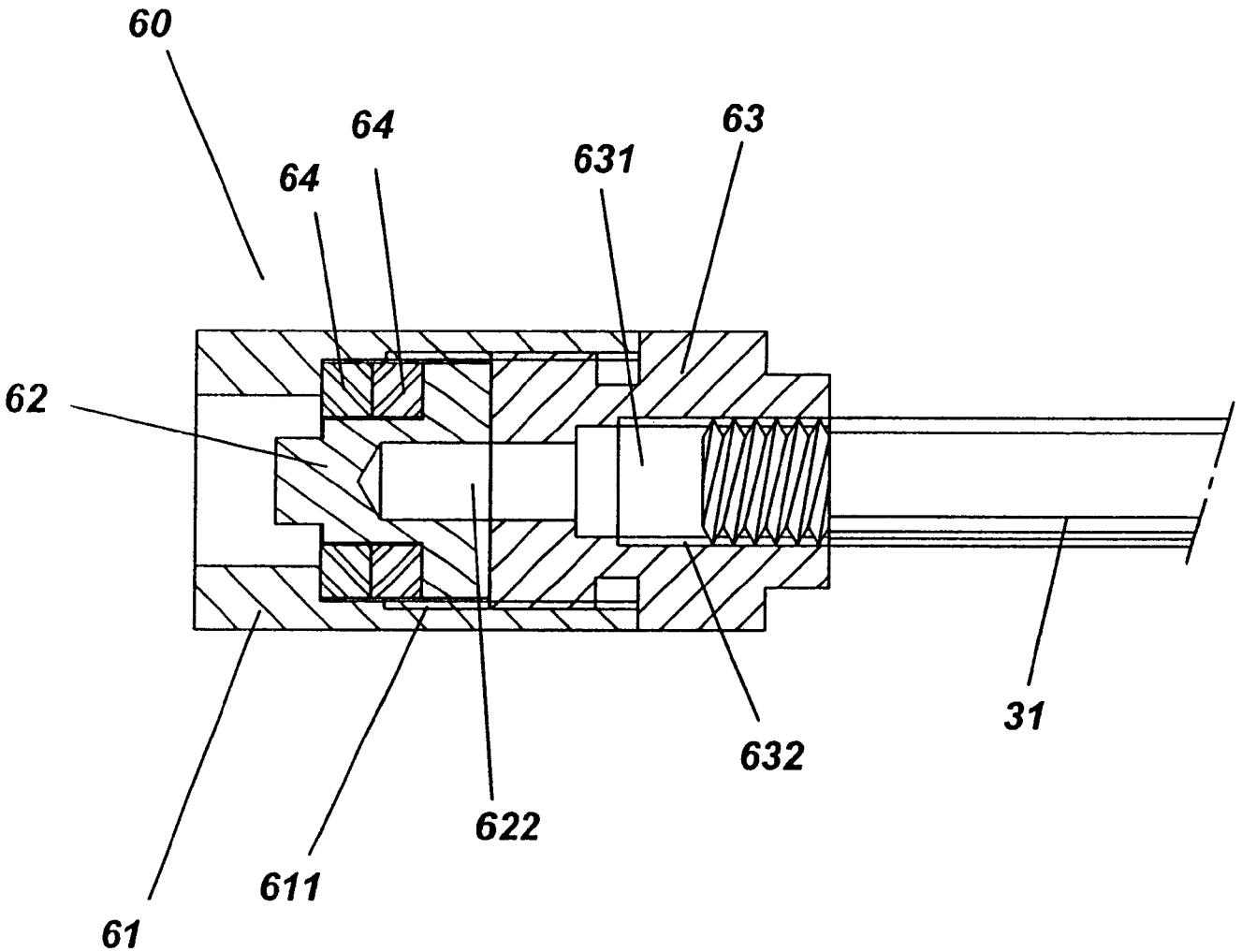
FIG. 9 is a cross-section view showing a combined charging adapter of the present invention.
Figure 10:
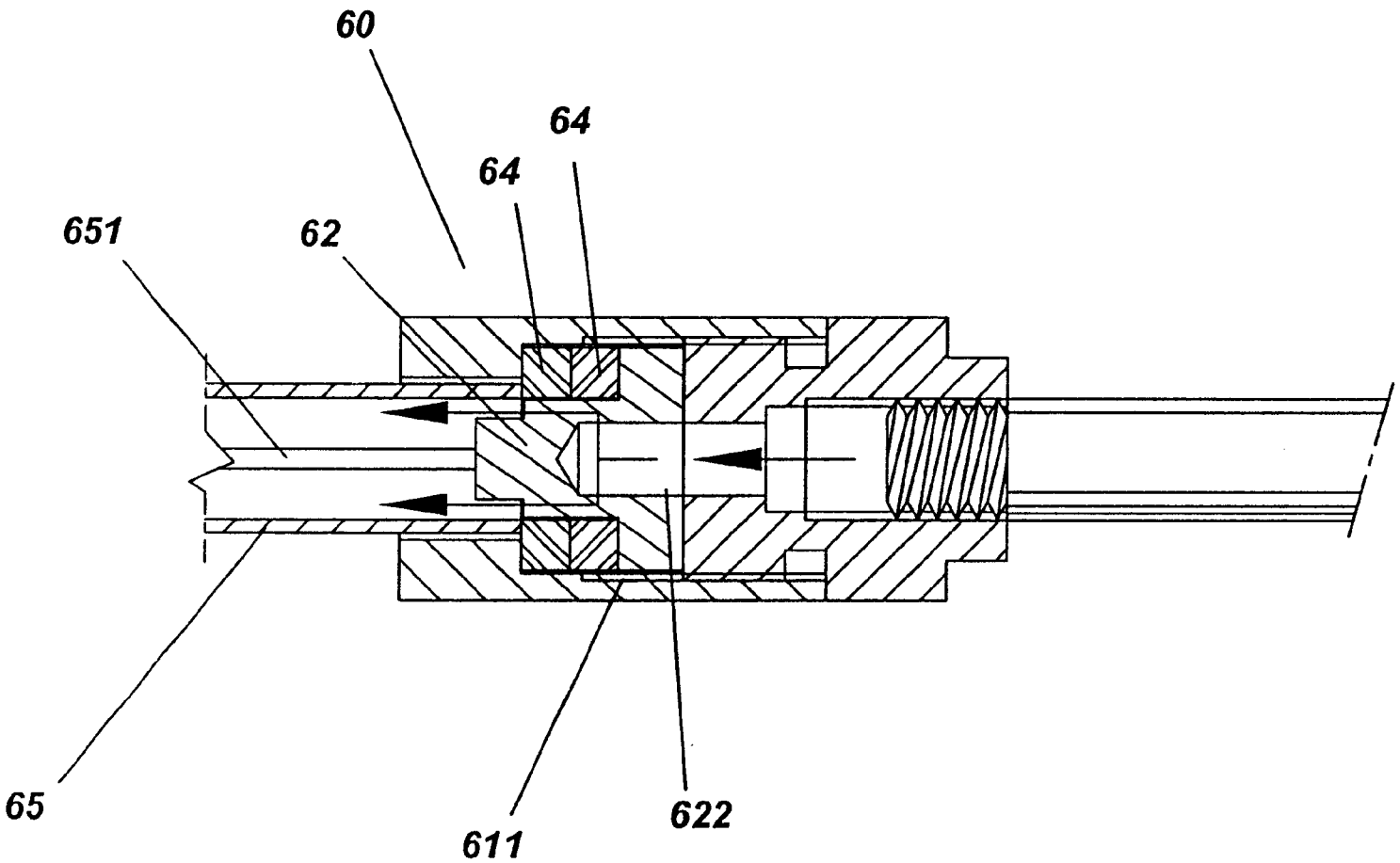
FIG. 10 is a cross-section view showing the working state of the charging adapter of the present invention.

Referring to FIG. 8 and FIG. 9, securing an charging adapter 60 on the tip end of the blowpipe 31 can be used for inflating variety tires of wheels. Said charging adapter 60 includes a main-body 61 having a hollow stepped hole with a internal thread 611, a push key 62 that has a stepped pin end with a both flat sides 621 thereon two side flow holes connecting to the back end hole, placed in the inside of the main-body 61, rubber washers 64 for putting on the stepped pin carrying on sealing function, and a connector 63 having a hollow hole 631, an outside thread at the front end for securing on the back end of the main-body 61, and a back inside thread 632 for securing on the tip end of the blowpipe 31. Referring to FIG. 10, when push said charging adapter 60 on the knockout pin 651 of the charging valve 65 of the tire so that the rubber washers 64 are pressed down to allow the compressed air give out from the side flow holes and via the vent hole 622 of the knockout pin 62 entering the inside of the tire to meet the necessary of inflating tire.

Plug-in Pumping Up Function

Figure 12:
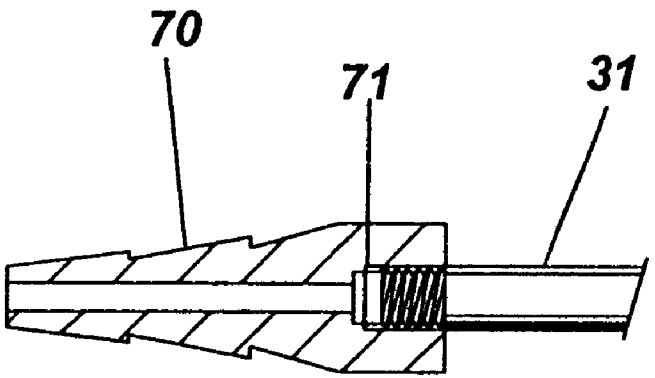
FIG. 12 is a cross-section view showing a plug-in inflating nozzle of the present invention.
Figure 11:
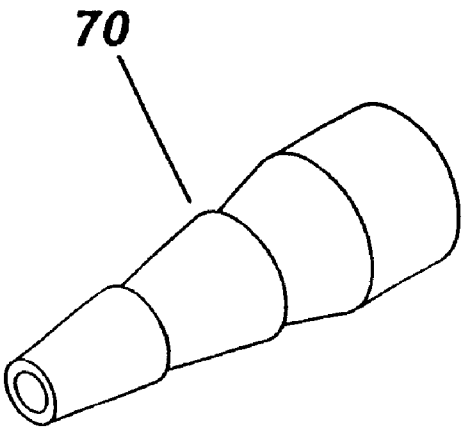
FIG. 11 is a solid view showing a plug-in inflating nozzle of the present invention.

Referring to FIG. 11 and FIG. 12, a plug-in charging connector 70 has an internal thread 71 at the back end for securing on the tip end of the blowpipe 31, and a cone anti-slip plug-in charging connecting end for plugging into the charging valves of inflating ring, air bed or swimming ring and so on to pump it up directly.

Low-pressure Nozzle Function

Figure 14:
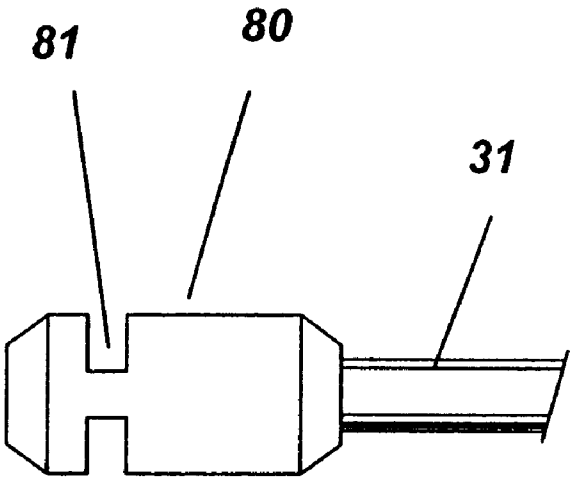
FIG. 14 is a side view of FIG. 13.
Figure 13:
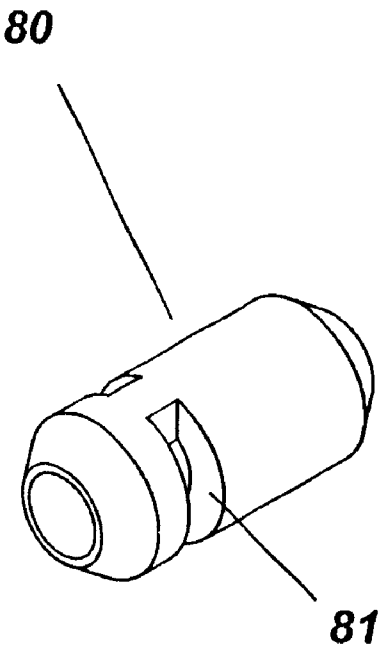
FIG. 13 is a solid view showing a low-pressure nozzle of the present invention.

Referring to FIG. 13 and FIG. 14, a low-pressure nozzle 80 securing on the tip end of the blowpipe 31 of the present invention has two inlets 81 at both sides absorbing outside air as the compressed air passing through to reduce the spraying pressure and to increase air flow of blowing and spreading area of spraying.

Soft Nozzle Function

Figure 15:
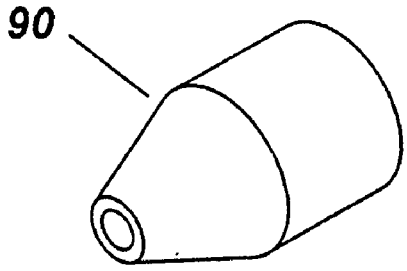
FIG. 15 is a solid view showing a softy nozzle.
Figure 16:
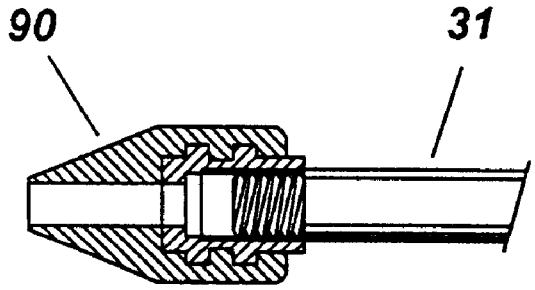
FIG. 16 is a cross-section view of FIG. 15.
Figure 17:
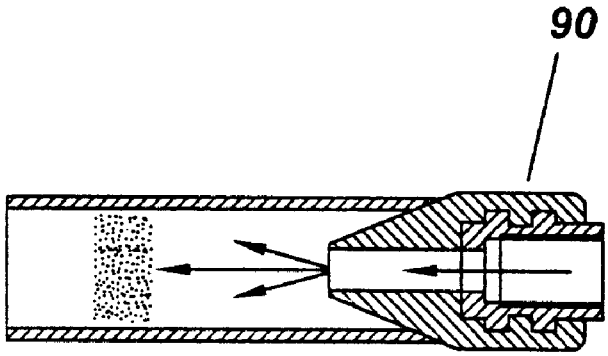
FIG. 17 is a cross-section view showing working state of the softy nozzle.

Referring to FIG. 15 and FIG. 16, a soft nozzle 90 securing on the tip end of the blowpipe 31 provided by the present invention can protect the surface of metal or coated with layer without occurring sketching harm as touching against by the soft head. Referring to FIG. 17, when the cone soft head of the soft nozzle 90 is put into the inside of a pipe to blow out the dust at inside of the pipe, the soft nozzle 90 not only can seal the pipe, but also protect the interconnecting surface of the pipe, and join on or off rapidly and facilitating operating.

Vent Wire Inflating Function

Figure 18:
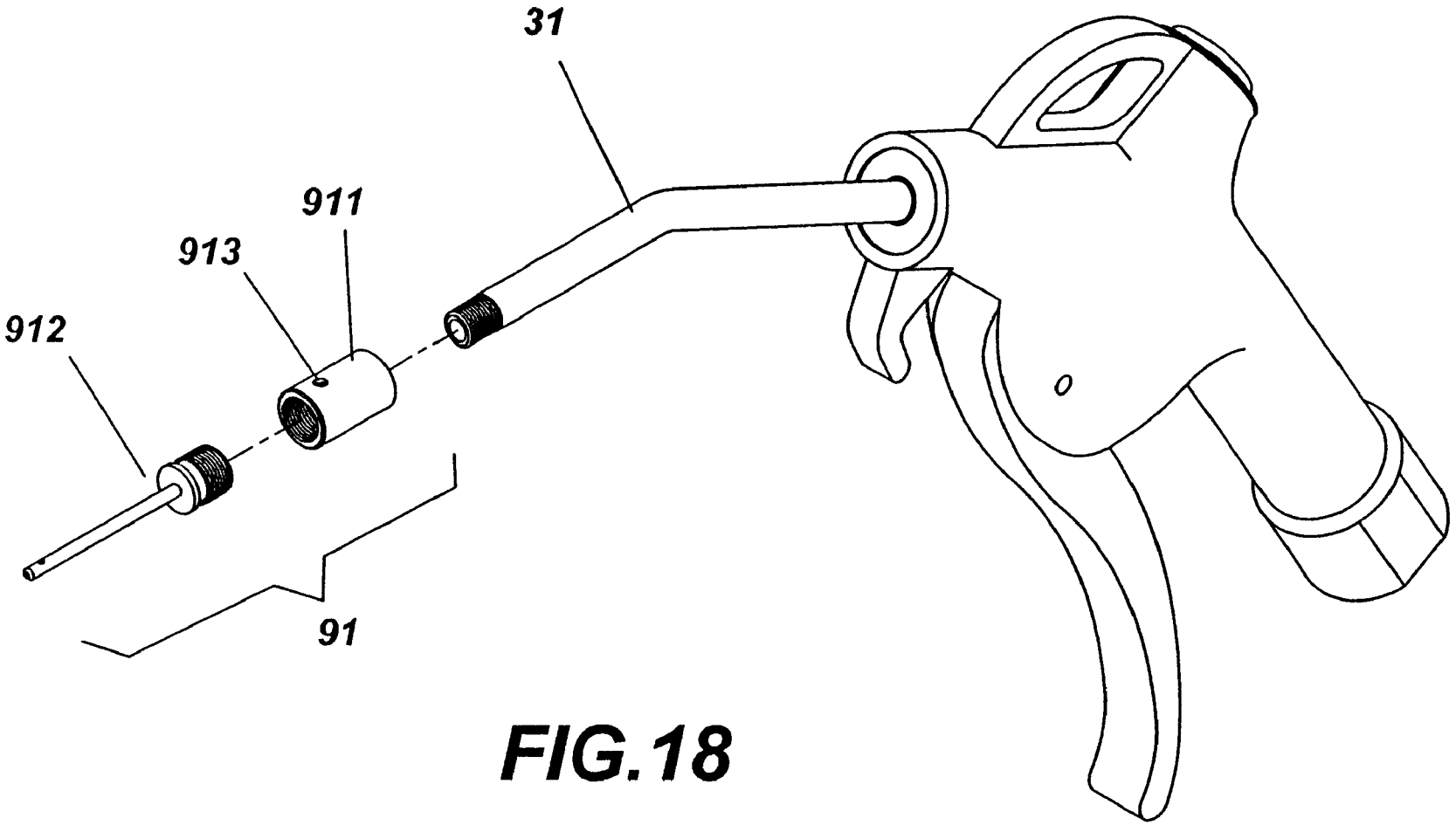
FIG. 18 is an exploded view showing connecting to a vent wire of the present invention.
Figure 19:
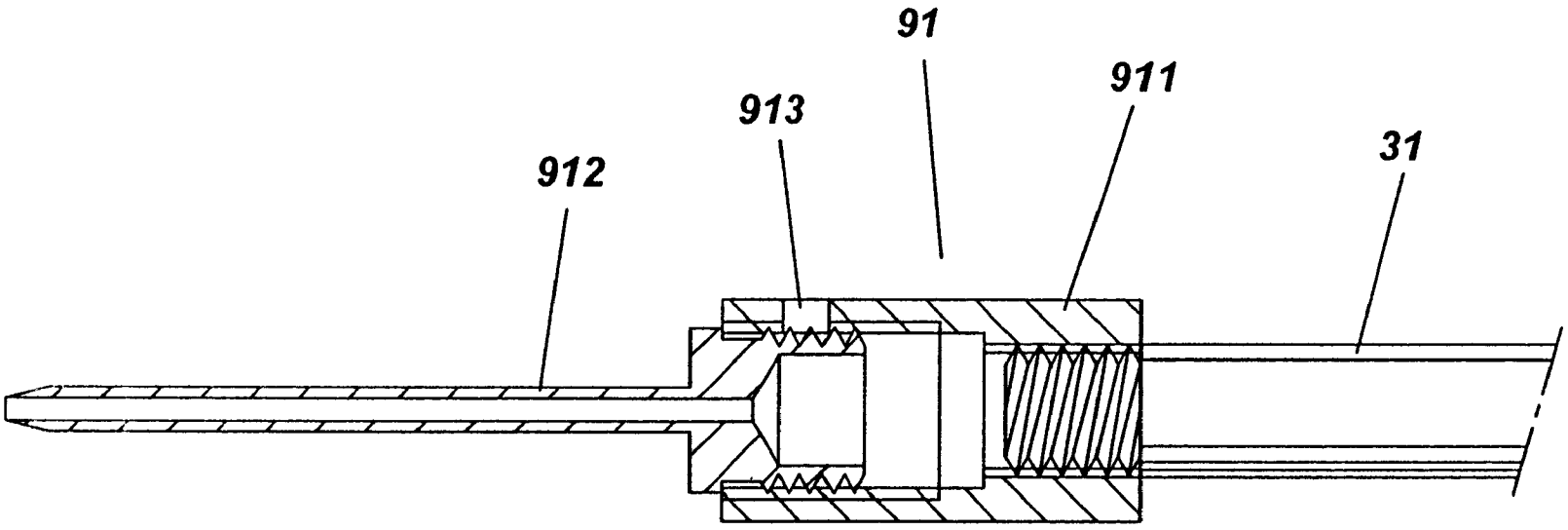
FIG. 19 is a cross-section view of FIG. 18.
Figure 20:
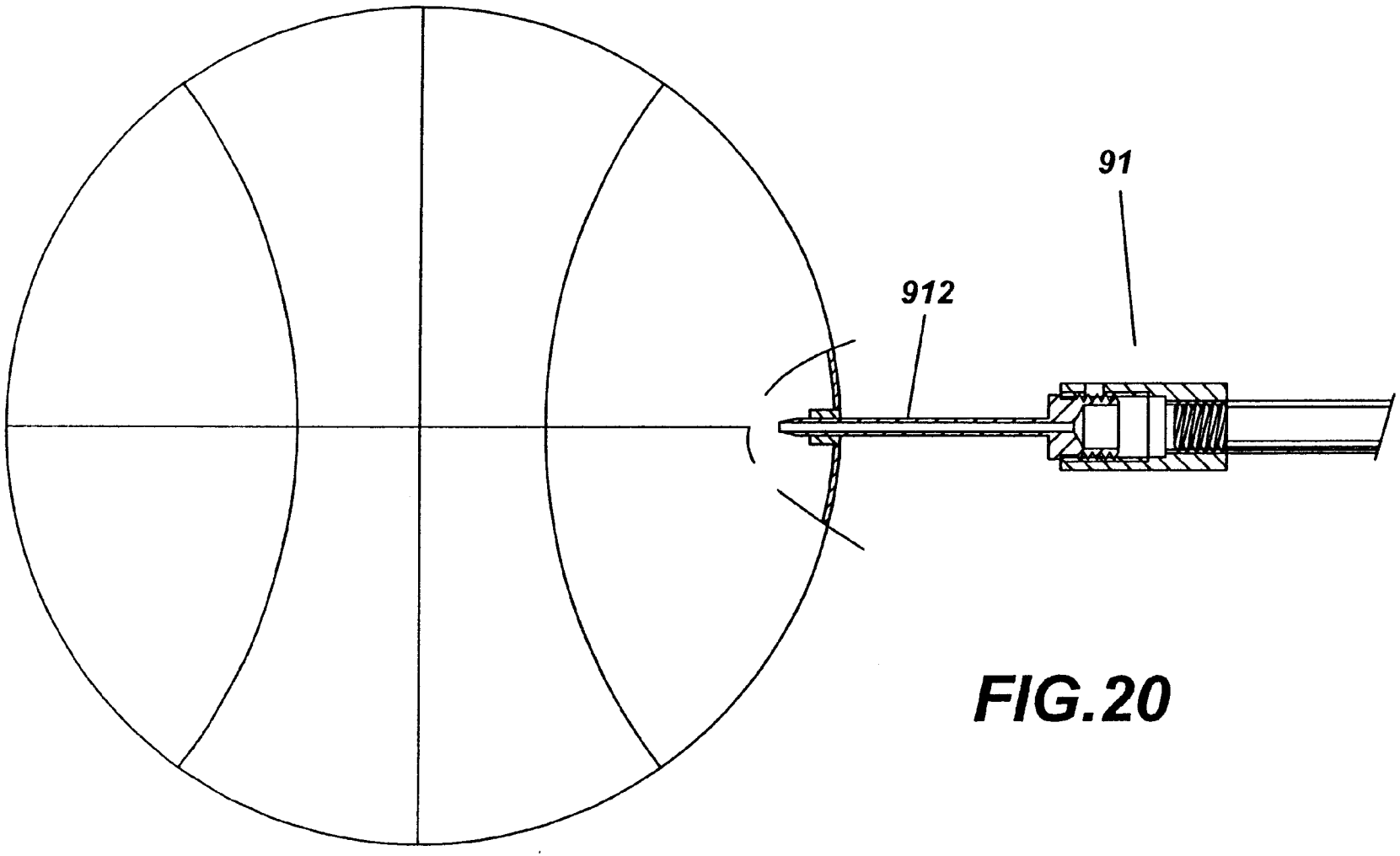
FIG. 20 is a cross-section view showing the working state of cooperating with the vent wire of the present invention.

Referring to FIG. 18 and FIG. 19, a vent wire secured on the tip end of the blowpipe 31 provided by the present invention can inflate every kind of balls (as shown in FIG. 20) directly, wherein a main body 911 connects a needle valve 912 to the tip end of the blowpipe 31. Said main body 91 provides a threaded end for securing on the tip end of the blowpipe 31, and the another threaded end for securing in the needle valve 912, and an escape orifice 913 formed on the proper side position for taking out the compressed air to avoid the danger of operation as the spraying hole of the needle valve is blocked.

In accordance with above-described, the air blowgun provided by the present invention not only has all the functions of a conventional blowgun, but also by means of the connecting thread at the tip end of the blowpipe can be connected with variety nozzles to meet different necessaries in different working sites and purposes. The feathers of it are occupation small volume, mounting and replacing rapidly, facilitating operation, good practicability, and convenient for carryover, improving the professional function of the blowgun, meanwhile integrating multiple functions in one blowgun and saving a quite mount of money for equipping attachments for meeting to carry out other purposes. It has quite huge practicability and great value of industry.

I claim:

1. A multipurpose air blowgun and replaceable nozzle comprising a blowpipe with a connecting thread formed on a distal end thereof and a selected one of a plurality of nozzles threadedly coupled to said connecting thread, said selected nozzle being a screen nozzle, said screen nozzle including a main body having a hollow interior and a baffling key contained in said hollow interior of said main body, said baffling key being formed with a threaded hole at an end thereof for threaded coupling with said connecting thread of said blowpipe and passage of compressed air therethrough, said screen nozzle having a ring-shaped gap formed between and interior wall of said main body and a portion of said baffle key, said screen nozzle including a magnet piece embedded into a distal end thereof, and a guide slot crossing opposing sides of said screen nozzle and in fluid communication with said threaded hole for passage of the compressed air into said ringshaped gap to form a ring-shaped air stream from said screen nozzle.

2. A multipurpose air blowgun and replaceable nozzle comprising a blowpipe with a connecting thread formed on a distal end thereof and a selected one of a plurality of nozzles threadedly coupled to said connecting thread, said selected nozzle being a charging adapter for inflating a variety tires, said charging adapter including (a) a connector having a through bore with an internally formed thread for threaded coupling with said connecting thread, said connector having an externally formed thread on a distal end thereof, (b) a longitudinally extended main-body having a stepped hole formed longitudinally therethrough in fluid communication with said through bore of said connector, said main body having a internal thread threadedly coupled to said external thread of said connector, (c) a push key disposed in said stepped hole and having a stepped pin end with a pair of flat sides thereon and two side flow holes coupled in fluid communication with said stepped hole, and (d) a plurality of rubber washers disposed on said stepped pin within said stepped hole for performing a sealing function.

* * * * *